US006789963B2

(12) United States Patent
Brahier et al.

(10) Patent No.: US 6,789,963 B2
(45) Date of Patent: Sep. 14, 2004

(54) CONTINUOUS STRIP BAG FEEDER AND LOADER WITH PIVOTABLE INTEGRATED PRINTER ASSEMBLY

(75) Inventors: Timothy E. Brahier, Rome, WI (US); James W. Gleesing, Whitewater, WI (US)

(73) Assignee: Sharp Packaging Systems, Inc., Sussex, WI (US)

( * ) Notice: Subject to any disclaimer, the term of this patent is extended or adjusted under 35 U.S.C. 154(b) by 0 days.

(21) Appl. No.: 10/208,981

(22) Filed: Jul. 31, 2002

(65) Prior Publication Data

US 2004/0022569 A1 Feb. 5, 2004

(51) Int. Cl.[7] ..... B41J 15/16; B41J 15/02; B41J 3/407; B41J 25/304

(52) U.S. Cl. ..... 400/120.16; 400/618; 400/613; 347/197

(58) Field of Search ..... 53/459, 372, 468, 53/469, 570; 400/611, 613, 618, 120.16, 120.17; 347/197, 198

(56) References Cited

U.S. PATENT DOCUMENTS

| | | | | |
|---|---|---|---|---|
| 4,490,963 A | | 1/1985 | Knudsen | 53/559 |
| 4,790,118 A | | 12/1988 | Chilcoate | 53/411 |
| 4,899,520 A | | 2/1990 | Lerner et al. | 53/459 |
| 5,468,080 A | * | 11/1995 | Jones | 400/618 |
| 5,505,550 A | * | 4/1996 | Kitahara et al. | 400/618 |
| 5,820,280 A | * | 10/1998 | Fox | 400/644 |
| 5,860,270 A | * | 1/1999 | Gerwe | 53/477 |
| 6,470,648 B1 | * | 10/2002 | Baker | 53/411 |

FOREIGN PATENT DOCUMENTS

| | | | | |
|---|---|---|---|---|
| EP | 0 562 288 A2 | | 10/1933 | |
| EP | 0 564 288 A3 | | 10/1993 | |
| GB | 1533173 | | 11/1978 | |
| GB | 2 142 282 | | 1/1985 | |
| JP | 11254718 A | * | 9/1999 | ..... B41J/2/325 |
| JP | 2000-128103 | | 5/2000 | |
| WO | WO 00/32477 | | 6/2000 | |

OTHER PUBLICATIONS

Machine translation of JP 11254718 to Sogabe from Japanese Patent Office website.*

Patent Abstracts of Japan vol. 2000, No. 10, Nov. 17, 2000 and JP 2000 185703 (Tooshoo:KK); Jul. 4, 2000.

Patent Abstracts of Japan vol. 2000, No. 08. Oct. 6, 2000 and JP 2000 142602 (Takazono Sangyo KK), May 23, 2000.

Patent Abstracts of Japan vol. 1997, No. 02, Feb. 23, 1997 and JP 08 266590 (Tokyo Shokai:KK), Oct. 14, 1996.

"Change Your Total Packaging Costs with the Dependable BPS–2" brochure, Sharp Packaging Systems, Inc. (admitted prior art).

U.S. patent application Publication No. US 2002/0062920 A1, Brahier et al., published May 30, 2002.

* cited by examiner

*Primary Examiner*—Daniel J. Colilla
(74) *Attorney, Agent, or Firm*—Andrus, Sceales, Starke & Sawall

(57) ABSTRACT

A packaging apparatus for feeding and loading a continuous strip of bags that includes an integrated printer assembly for printing information on each individual bag of the continuous strip. The printer assembly is pivotally mounted to a support frame and receives the continuous strip of bags from a bag feed assembly. The packaging apparatus includes a bag feeding assembly having a drive roller and a platen roller driven from a common motor. The drive roller advances the continuous strip of bags through the apparatus, while the platen roller is in contact with the print head and printer ribbon to advance the printer ribbon when the bags are being printed. The packaging apparatus includes a bag tensioning assembly that supports the supply roll of bags and maintains tension on the bags as the bags are advanced through the device.

28 Claims, 9 Drawing Sheets

FIG. 9
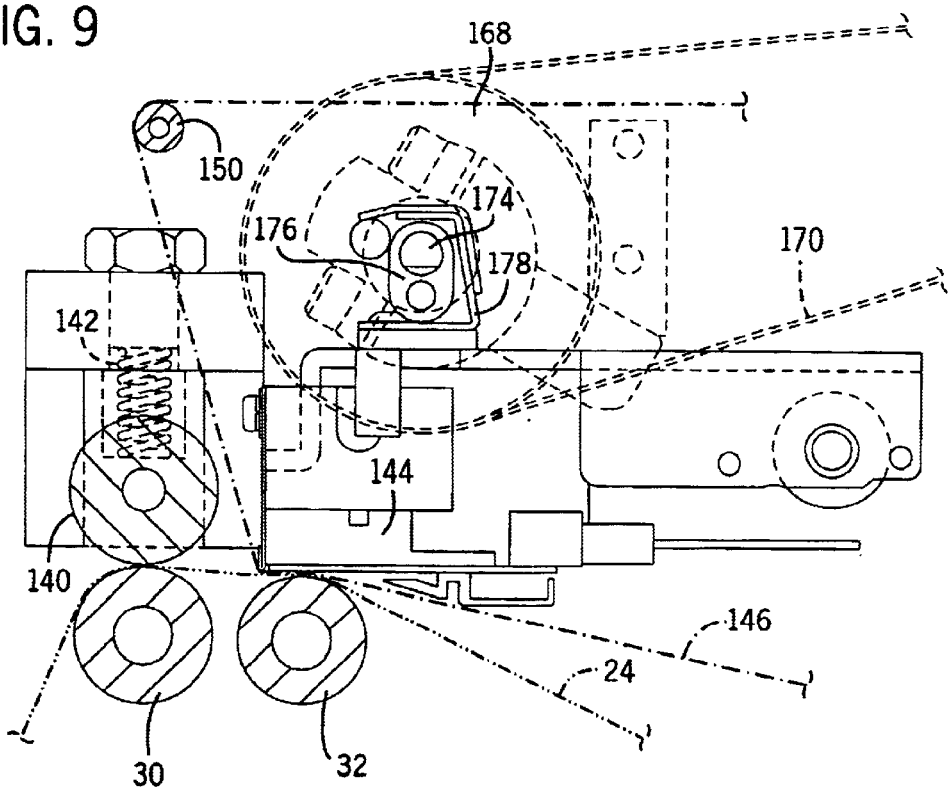
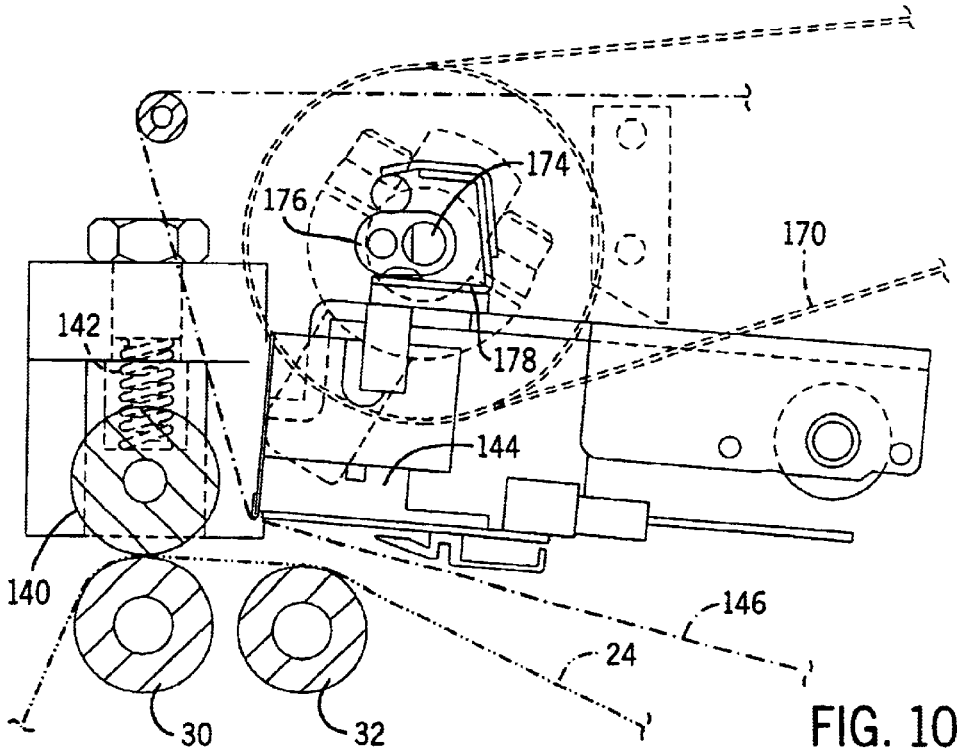
FIG. 10

CONTINUOUS STRIP BAG FEEDER AND LOADER WITH PIVOTABLE INTEGRATED PRINTER ASSEMBLY

BACKGROUND OF THE INVENTION

The present invention relates to a packaging apparatus for feeding and loading individual bags formed in a continuous strip in which successive bags are connected end-to-end. More specifically, the present invention relates to a fully electric packaging apparatus that includes an integrated printer assembly that is pivotable away from the drive rollers used to feed the continuous strip of bags, wherein the integrated printer assembly prints a label or product marking on each of the bags in the continuous strip immediately prior to the printed bag being loaded with the product being packaged.

Currently, many manufacturers utilize automated loading machines to load products to be packaged into individual plastic bags. The plastic bags are typically contained in a "wicket" in which successive bags are stacked on top of each other and held in alignment by a header having a series of wicket rods. Once each bag is filled with the product to be packaged, the bag is torn along a line of perforation and separated from the header that aligns the stack of bags. After the bag has been filled with the product, the bag is transferred to a drop sealer in which the two layers of plastic forming the bag are heat sealed in a conventional manner. Although the combination of a wicketed bag loading machine and a drop sealer is in wide use and has proven to be effective, drawbacks exist in the use of plastic bags stacked in the wicket package.

One such drawback is the limitation in the type of printing that can be applied to the individual bags in the wicket. Since the bags in the wicket are stacked on top of each other and are loaded with a product while still attached to the wicket header, there is no possibility of printing a design on the plastic bag prior to the insertion of the product. Although the wicketed bags could be printed prior to assembly into the wicketed packet, the manufacturer of the wicketed bags typically mass produces the bags without customizing the bags for the individual customer. Thus, if the customer wishes to imprint information on the bags after purchase from the manufacturer, the wicketed bags must be imprinted after the product has been loaded and the wicketed bag sealed by the drop sealer. If the product being sold in the sealed plastic bags includes an irregular surface, printing after the bag has been filled can prove to be a difficult and imprecise proposition.

Recently, continuous strips of bags that are end connected have become available for use in packaging products. Each of the bags in the continuous strip includes an open end that is connected to the closed end of the next bag in the continuous strip. Rolls of continuous strip bags can include at least 1000 bags. However, the automated feeding and loading of the continuous strip of bags has also presented problems in the feeding of the bags from the supply source and the opening of the bags in the continuous strip prior to loading of the products to be packaged.

In currently available packaging apparatus that open and load continuous strips of bags that are end connected, the printing on each bag is done by a printer that is typically located upstream from the location at which the printed bag is loaded with the product being packaged. Although an upstream printer is adequate when loading identical products into bags such that the printing on each individual bag does not have to correspond to the particular product being packaged, drawbacks exist if the bag feeding and loading apparatus is used to package products that are specialized and require specific labeling for the product being packaged. For example, if the bag feeding and loading apparatus is used to package medical prescriptions for individual patients, it is critical that the information printed upon each individual bag matches the product being placed within the bag. In a feeding and loading apparatus in which several cycles of the apparatus take place between the printing of an individual bag and the loading of the same bag, an opportunity exists for misalignment between the printed product packaging and the actual product being inserted therein.

In addition to the possible misidentification that can occur due to the number of bags positioned between the bag being loaded and the bag being printed, the printed bags extending between the loading area and the printing area result in wasted product during changeovers from bag types or the type of printing being placed upon the bag. In many cases, as many as four to six bags can be wasted during each changeover.

Another drawback that exists in currently available packaging apparatus is the number of rollers and drive assemblies required to operate both the printer and the bag drive assembly. In addition to the increase in number of parts and cost, the complex path through which the continuous strip of bags travels increases the amount of time required to load a new strip of bags into the packaging apparatus. Further, the multiple drives require complicated timing arrangements to insure that the bag feeding and printer assembly operate at the same speed in order to position the printed material on the bag in the correct location.

Therefore, it is an object of the present invention to provide an apparatus that can be used to print, feed and seal individual bags with increased accuracy. Further, it is an object of the present invention to provide such an apparatus that allows an article to be positioned into the bag immediately following the printing of the bag by the integrated printing assembly. Further, it is an object of the present invention to position the printing assembly directly above the bag feeding assembly. It is an additional object of the invention to provide a printer assembly that can be rotated away from the bag drive assembly to increase the ease of loading of the continuous strip of bags. Further, it is an object of the present invention to provide a fully electronic apparatus that requires no compressed air to operate.

SUMMARY OF THE INVENTION

The present invention is a packaging apparatus for feeding, printing and sealing a bag from a continuous strip of bags. The packaging apparatus of the present invention is particularly desirable in presenting individual bags for loading individualized products into successive bags where each of the bags must be individually printed with information specifically related to the product being placed within the bag.

The packaging apparatus of the present invention includes a bag feeding assembly mounted to a stationary support frame. The bag feeding assembly receives the continuous strip of bags from a supply roll that is mounted to a bag tensioning assembly. The continuous strip of bags passes over a drive roller that is operable to pull the continuous strip of bags from the supply roll.

The bag feeding assembly further includes a platen roller positioned adjacent to the drive roller. Both the drive roller and the platen roller are commonly driven by an electric drive motor. The electric drive motor is coupled to the drive roller and the platen roller through a belt assembly such that both the drive roller and the platen roller are rotated at a common speed.

After the continuous strip of bags passes over the bag feeding assembly, the continuous strip of bags is received by a bag sealing assembly. The bag sealing assembly is operable to seal the open mouth of each bag after the bag has been loaded with a product.

The bag sealing assembly includes a pressure bar mounted between a pair of spaced side arms. The pressure bar includes a anvil plate that presses the open end of the bag into a heated wire to seal the open mouth of each bag after the bag has been loaded. Each of the side arms of the bag sealing assembly is movable toward and away from the stationary support frame of the packaging apparatus.

Specifically, each of the side arms includes a rack member that receives a rotatable drive gear. The pair of spaced drive gears are connected by a shaft that is rotatably driven by an electric drive motor. As the electric drive motor rotates, the teeth of the drive gears engage the spaced rack members to move the side arms of the bag sealing assembly into and out of the support frame. In this manner, the entire bag sealing assembly is fully electric.

The bag tensioning assembly of the packaging apparatus includes a support shaft that extends through the hollow core of the supply roll. The rotatable support shaft includes a bias member positioned to exert a rotational bias force on the support shaft. Specifically, as bags are unwound from the supply roll, the rotating shaft loads the bias member. When tension created by the feeding assembly is removed from the continuous strip of bags, the bias member exerts a rotational bias force on the supply roll to rewind the continuous strip of bags and maintain the proper tension on the continuous strip of bags.

In a first embodiment of the invention, the bias member of the bag tensioning assembly is a torsion spring having a first end coupled to the support shaft and a second end coupled to a slip clutch. As the support shaft rotates when the continuous strip of bags are withdrawn from the supply roll, the slip clutch operates to maintain the desired load on the torsion spring. Specifically, the inner race of the slip clutch is coupled to an adjustment spring that sets the amount of tension required on the torsion spring before the slip clutch will release. By adjusting the strength of the adjustment spring, the slip clutch can properly load the torsion spring.

In a second embodiment of the bag tensioning assembly, the torsion spring bias member has a first end coupled to the support shaft and a second end coupled to the fixed support stand. The support shaft includes a friction block that contacts the core of the supply roll. A friction collar is installed on the opposite, outer end of the support shaft and includes a tension spring positioned between the collar and the core of the supply roll. The tension spring exerts a bias force to press the core against the friction block. As the support shaft rotates when the continuous strip of bags are withdrawn from the supply roll, the friction block slips relative to the core when the tension force of the torsion spring exceeds the friction force between the friction block and the core of the supply roll to maintain the desired load on the torsion spring. By adjusting the compression of the tension spring, the amount of tension force stored by the tension spring before slippage between the friction block and the core occurs can be adjusted.

The packaging apparatus further includes a printer assembly that is pivotable between a loading position and a printing position. In the printing position, the print head of the printer assembly is positioned adjacent to the platen roller of the bag feeding assembly. When a bag is to be printed by the printer assembly, a printer drive motor causes the print head to move downward into contact with the platen roller. The platen roller is driven to advance the printer ribbon through the printer assembly at the same speed as the speed of movement of the continuous strip of bags. Thus, the bag feeding assembly insures that the printer ribbon is advanced at the same speed as the continuous strip of bags.

The printer assembly can be released and pivoted away from the bag feeding assembly to the loading position. In the loading position, the continuous strip of bags from the supply roll can be quickly and easily fed through the packaging apparatus of the invention. Further, the positioning of both the drive roller and the platen roller of the bag tensioning assembly on the stationary support frame allows for quick, easy loading without threading the continuous strip of bags through multiple rollers.

As discussed above, the packaging apparatus of the present invention is capable of printing and loading each pre-opened bag during the operation of the packaging apparatus. The packaging apparatus positions the driven platen roller on the stationary support frame while allowing the printer assembly to move out of contact with the bag feeding assembly.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 9 is a side view taken along line 9—9 of FIG. 8 illustrating the movement of the print head into contact with the driver platen roller; and FIG. 10 is a side view similar to FIG. 9 illustrating the movement of the print head away from contact with the driver platen roller.

DETAILED DESCRIPTION OF THE INVENTION

Figure 1:
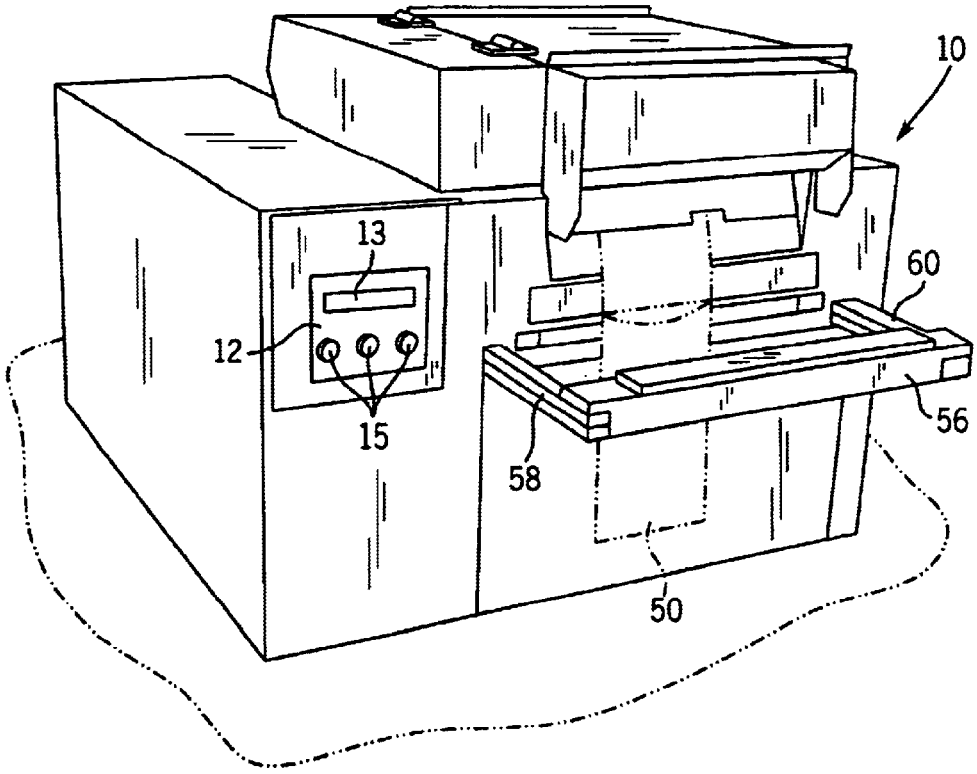
FIG. 1 is a perspective view of the packaging apparatus of the present invention.

FIG. 1 illustrates a packaging apparatus 10 of the present invention. The packaging apparatus 10 is a combination device that feeds a continuous strip of pre-opened bags from a supply roll, prints desired information on each bag of the continuous strip, positions each bag for loading with the product, and finally, seals each bag after the product has been inserted.

As illustrated in FIG. 1, the packaging apparatus 10 includes an electronic user interface 12 that allows the user of the packaging apparatus 10 to enter appropriate commands into a control unit (not shown) which controls the operation of the entire packaging apparatus 10. The user interface 12 generally includes a display screen 13 and several input devices 15 that allow the user to select various operations of the packaging apparatus 10.

Figure 2:
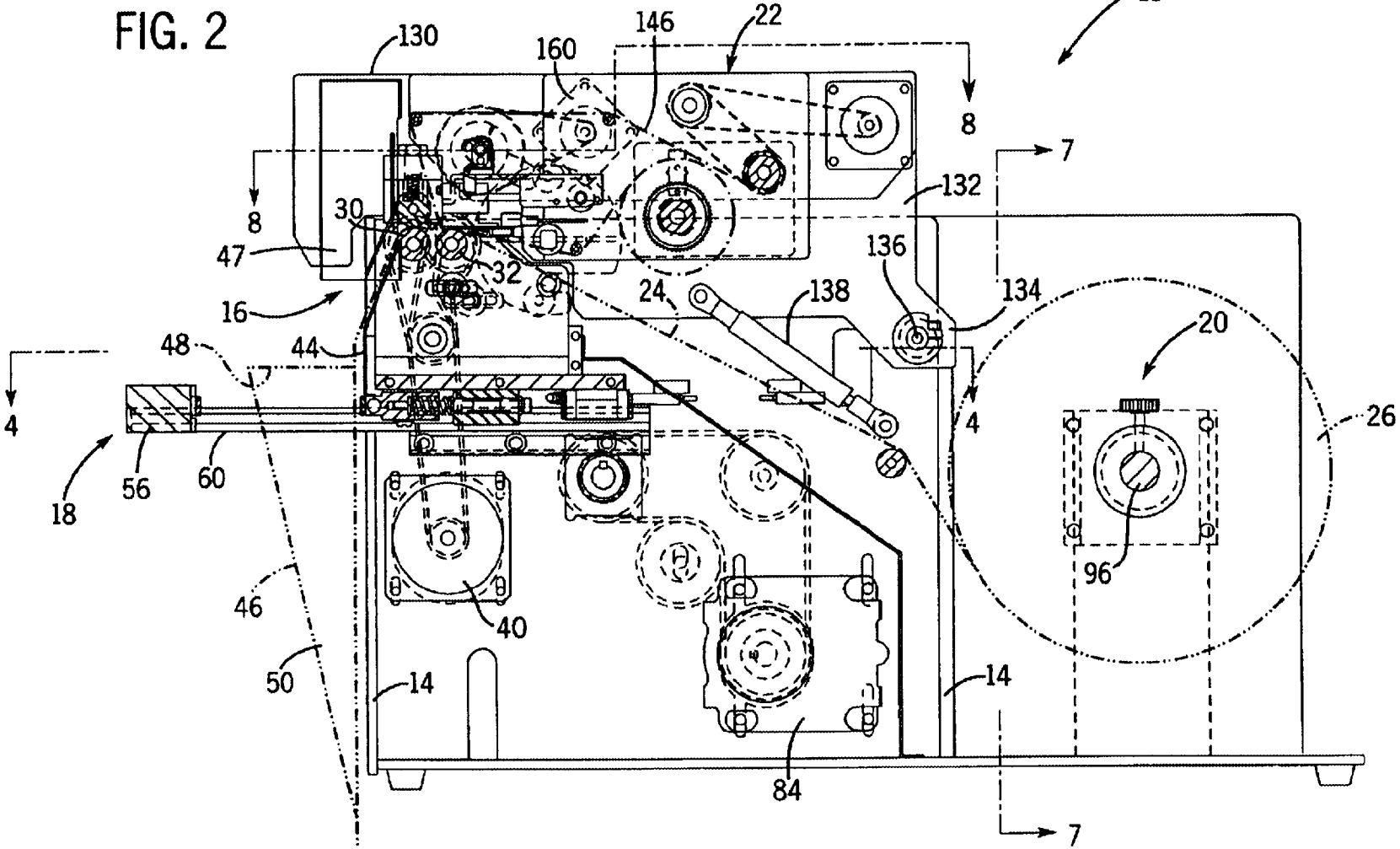
FIG. 2 is a cross-section view of the packaging apparatus of the present invention with the printer assembly in the printing position.
Figure 3:
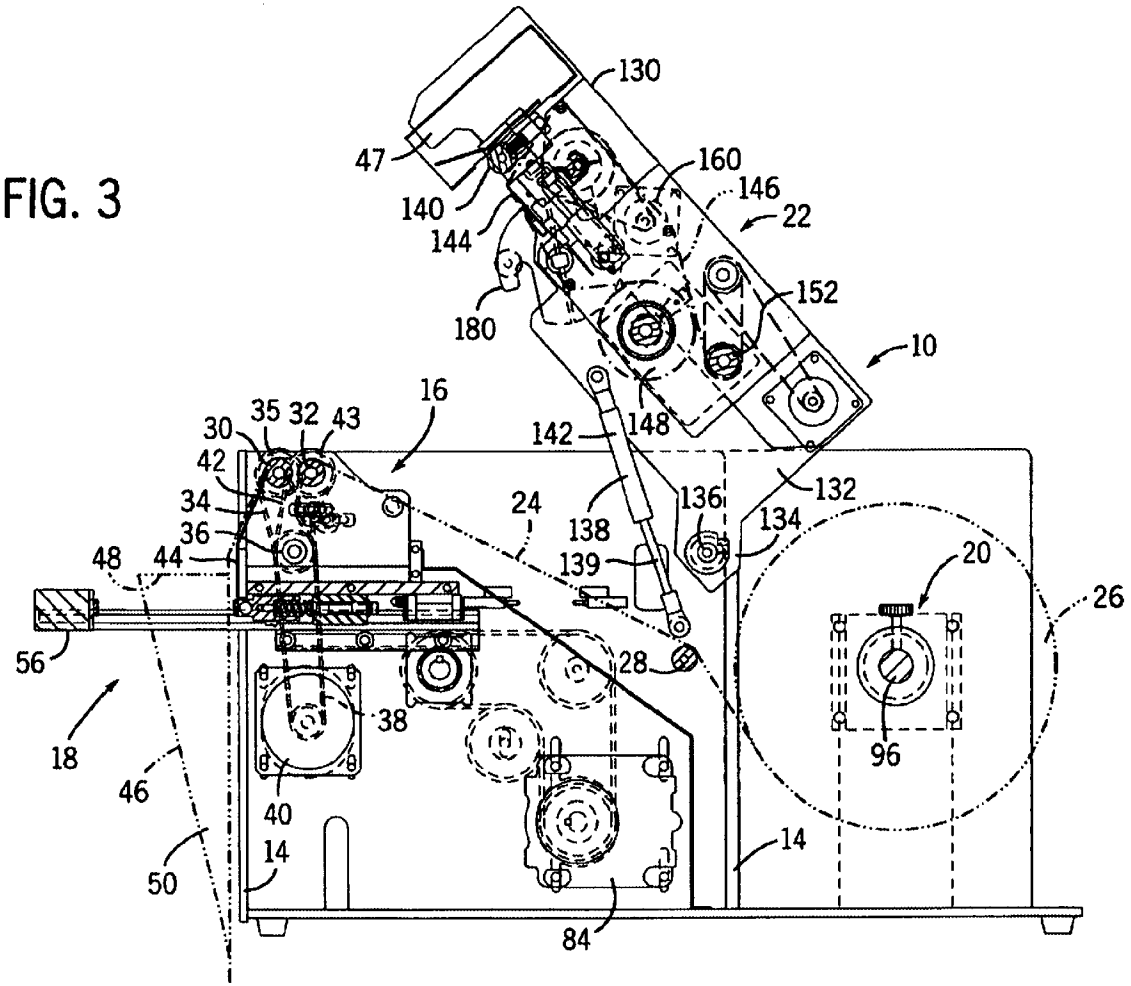
FIG. 3 is a view similar to FIG. 1 illustrating the printer assembly in the loading position.

Referring now to FIG. 2, the packaging apparatus 10 of the present invention generally includes a support frame or housing 14 that is used to mount and support the various operating components of the packaging apparatus 10. As can be seen in FIGS. 2 and 3, the support frame 14 supports a bag feeding assembly 16 and a bag tensioning assembly 20.

As can be seen in FIGS. 2 and 3, a printer assembly 22 is pivotally mounted to the support frame 14 such that the printer assembly 22 can move toward and away from the bag feeding assembly 16. As illustrated, the printer assembly 22 is movable between a closed, printing position shown in FIG. 2 and an open, loading position illustrated in FIG. 3. The operation of the printer assembly 22 and its movement between the printing and loading positions will be described in much greater detail below.

Referring now to FIG. 3, the operation of the bag feeding assembly 16 will now be described. As illustrated, a continuous strip of bags 24 is drawn through the packaging apparatus 10. Specifically, the continuous strip of bags 24 is shown as contained on a supply roll 26 that is rotatably supported by the bag tensioning assembly 20. The supply roll 26 is freely rotatable such that the continuous strip of bags 24 can be unwound and fed through the packaging apparatus 10.

The continuous strip of bags 24 passes over a support roller 28 and is directed over a drive roller 30 and a platen roller 32. The drive roller 30 is operable to pull the continuous strip of bags 24 from the supply roll 26, while the platen roller 32 functions in combination with the printer assembly 22 to print indicia on each bag of the continuous strip, as will be described in detail below.

As illustrated in FIG. 3, a secondary drive belt 34 extends between a pulley 35 connected to the drive roller 30 and an intermediate pulley 36. A primary drive belt 38 extends between a drive motor 40 and the intermediate pulley 36. Thus, the combination of the primary drive belt 38 and the secondary drive belt 34 provides the motive force to rotate the drive roller 30.

As illustrated in FIG. 3, a secondary drive belt 42 extends between the intermediate pulley 36 and a pulley 43 connected to the platen roller 32. Thus, rotation of the intermediate pulley 36 results in corresponding rotation of the platen roller 32. Since both the platen roller 32 and the drive roller 30 are coupled to the same intermediate pulley 36, both the drive roller 30 and the platen roller 32 are driven by the common drive motor 40. In the preferred embodiment of the invention, the secondary drive belts 34 and 42 are selected such that the drive roller 30 and the platen roller 32 are driven at a common speed. The operation of the drive motor 40 is controlled by the control unit of the packaging apparatus 10 in a conventional manner.

Referring now to FIG. 2, once the continuous strip of bags 24 has been pulled over the drive roller 30, the continuous strip 24 passes over an outlet plate 44 and the top layer 46 of the bag is blown open by a fan assembly (not shown) that directs a flow of air out of the front cavity 47. When the bag is open, product can be inserted through the open mouth 48. Once product has been inserted into the open bag 50, the bag sealing apparatus 18 is operated to seal the mouth 48 and separate the bag 46 from the continuous strip 24 along a line of perforation. The use of some type of bag sealing assembly to seal each bag after product has been loaded is well known in the art.

Figure 4:
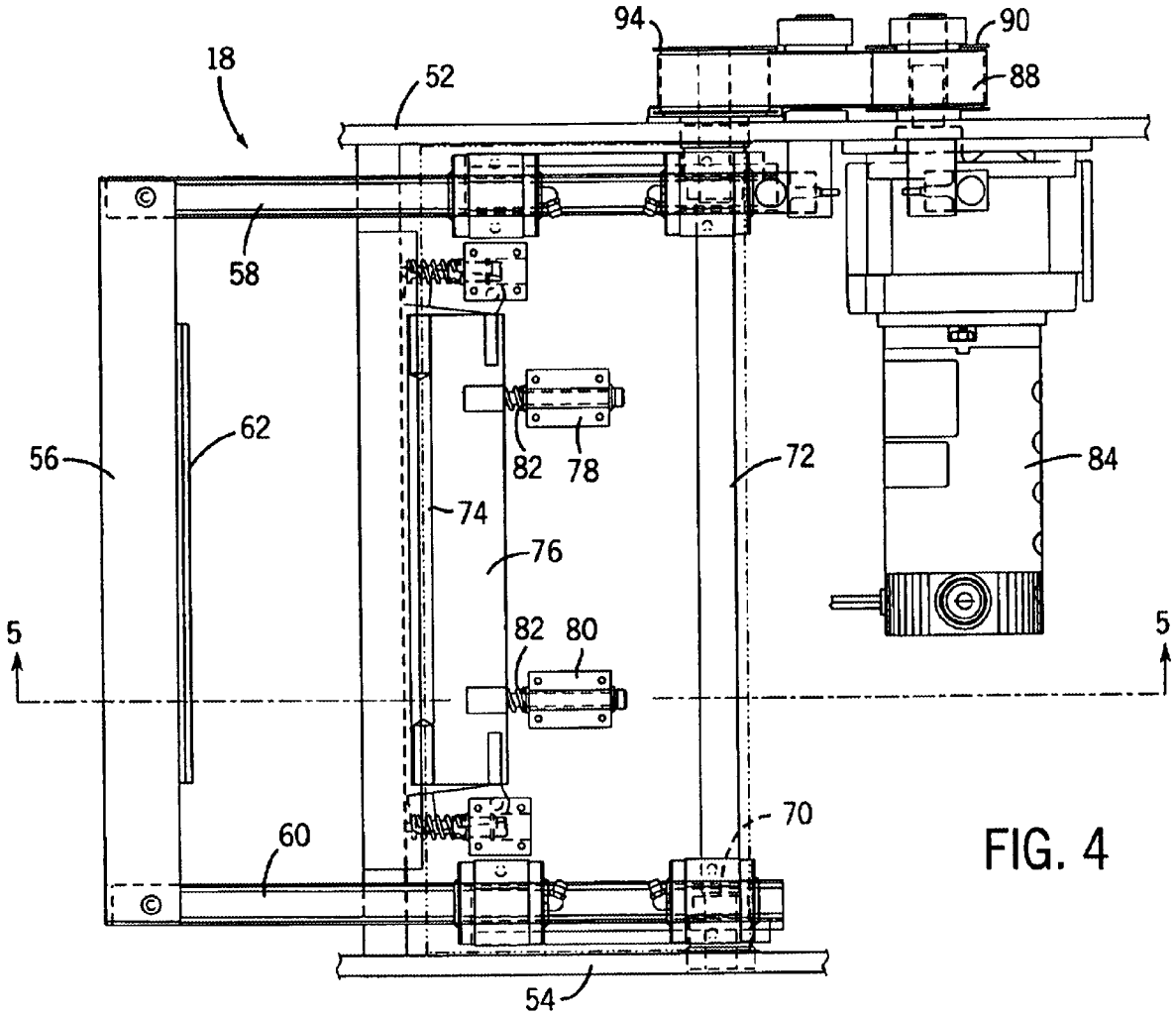
FIG. 4 is a top view taken along line 4—4 of FIG. 2.

Referring now to FIG. 4, thereshown is the bag sealing assembly 18 of the present invention. The bag sealing assembly 18 is supported by the sidewalls 52 and 54 of the support frame. The bag sealing assembly 18 includes a pressure bar 56 mounted transversely between a pair of spaced side arms 58, 60. The pressure bar 56 includes an anvil plate 62 that is used to form the seal across the open mouth of each bag of the continuous strip.

Figure 5:
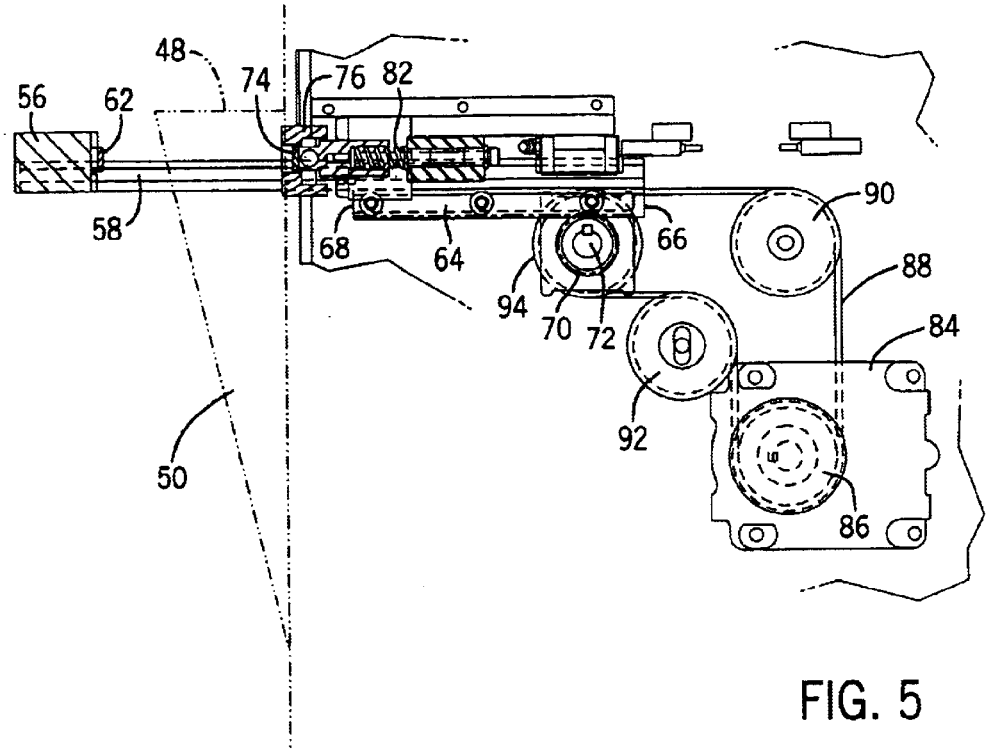
FIG. 5 is a partial section view taken along line 5—5 of FIG. 4 illustrating the pressure bar in its extended position.

Referring now to FIG. 5, each of the side arms 58, 60 includes a rack member 64 mounted beneath the respective side arm. The rack member 64 includes a plurality of individual spaced teeth that extend along the rack member 64 from an inner end 66 to an outer end 68. Each of the rack members 64 receives a drive gear 70. Each of the drive gears 70 include an outer circumference having a plurality of spaced teeth that are received between the corresponding teeth formed in the rack member 64.

As can be seen in FIG. 4, the drive gears 70 interact with each of the side arms 58, 60 and are joined to each other by a shaft 72. In this manner, the drive gears 70 positioned on opposite sides of the packaging apparatus 10 rotate at the same speed.

Referring back to FIG. 5, thereshown is the pressure bar 56 in its extended, loading position. When the pressure bar 56 is in the extended position, the mouth 48 of the bag 50 can be opened and product inserted into the bag 50.

Figure 6:
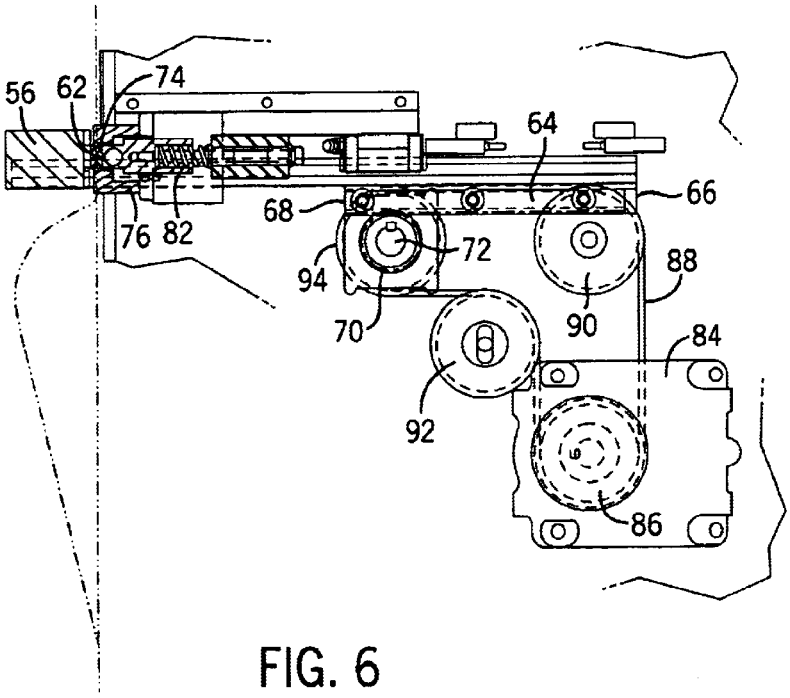
FIG. 6 is a side view similar to FIG. 5 illustrating the pressure bar in its retracted, sealing position.

Once the bag has been loaded with product, the pressure bar 56 is moved from the loading position illustrated in FIG. 5 to the sealing position illustrated in FIG. 6. When the pressure bar 56 is in the sealing position, the anvil plate 62 contacts a heated sealing plate 74 mounted to the support frame. As can be seen in FIG. 4, the heated sealing plate 74 is positioned on a sealing block 76 that is resiliently mounted relative to the support frame by a pair of shock absorbers 78 and 80. The shock absorbers 78, 80 each include a resilient spring member 82 that allows the sealing block 76 to absorb the force of contact between the pressure bar 56 and the sealing block 76.

The movement of the pressure bar 56 from the loading position of FIG. 5 to the sealing position of FIG. 6 is controlled by a drive motor 84. The drive motor 84 includes a drive pulley 86. The drive pulley 86 receives a drive belt 88. The drive belt 88 passes around a pair of idler pulleys 90 and 92. Further, the drive belt 88 passes around a pulley 94 coupled to the shaft 72 that includes the pair of drive gears 70. Since the drive gears 70 on each side of the bag sealing assembly are joined by the shaft 72, the single drive motor 84 simultaneously controls the movement of the pair of side arms 58 and 68, and thus the pressure bar 56, between the loading position and the sealing position.

In the preferred embodiment of the invention, as illustrated in FIG. 4, the drive motor 84 is an electric motor. Therefore, the movement of the pressure bar 56 between its extended, loading position and the retracted, sealing position is electrically controlled by the control unit for the entire packaging apparatus 10.

Referring back to FIG. 3, the bag tensioning assembly 20 is positioned to support the supply roll 26 and maintain tension on the continuous strip of bags 24 as the continuous strip is pulled through the packaging apparatus 10 by the bag feeding assembly 16. Specifically, the bag tensioning assembly 20 maintains tension on the continuous strip of bags 24 after the drive roller 30 and platen roller 32 stop operation and the continuous strip 24 is no longer being unwound. At this time, the bag tensioning assembly 20 exerts a reverse rotational bias force on the continuous strip 24 to maintain tension on the strip 24.

Figure 7:
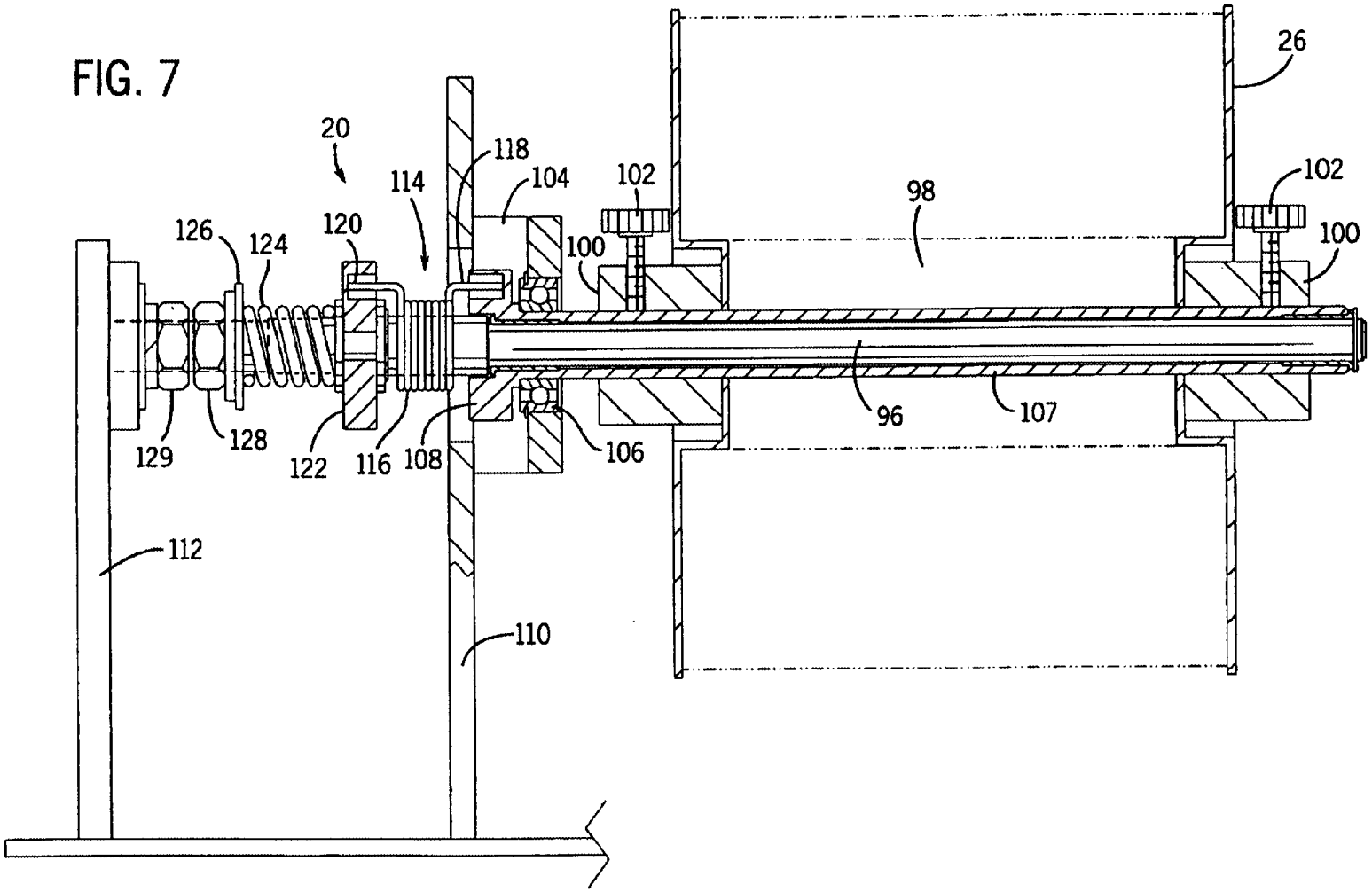
FIG. 7 is a view taken along line 7—7 of FIG. 2 illustrating a first embodiment of the bag tensioning assembly of the present invention.

Referring now to FIG. 7, thereshown is a first embodiment of the bag tensioning assembly 20 of the present invention. The bag tensioning assembly 20 includes a support shaft 96 that passes through core 98 of the supply roll 26. A pair of locking collars 100 are positioned on opposite sides of the core 98 and each include a locking knob 102 that can be tightened into contact with the outer circumference of the support shaft 96.

The support shaft 96 passes through a support collar 104 and is rotatably supported by a bearing assembly 106. The support shaft 96 is surrounded by an axial shaft sleeve 107 that rotates about the shaft 96 and includes an expanded flange 108 that is rotatable within the support collar 104. The support shaft 96 extends through the support wall 110 and is ultimately supported at its outer end by a stand 112.

The bag tensioning assembly 20 includes a bias member 114 that surrounds the shaft sleeve 107. The bias member 114 exerts a rotational bias force on the shaft sleeve 107 to maintain tension on the continuous strip of bags 94 when the bags are no longer being actively unwound from the supply roll 20. Specifically, the bias member 114 exerts a bias force to rotate the supply roll 26 in the counter-clockwise direction when viewed from the side, as illustrated in FIG. 3. As illustrated, the continuous strip of bags 24 is withdrawn from the supply roll 26 by rotating the supply roll 26 in the clockwise direction. Thus, the bias member 114 exerts a force to rewind the continuous strip 24 onto the supply roll 26 when the bags are no longer being withdrawn.

Referring back to FIG. 7, the bias member 114 in the preferred embodiment of the invention is a torsion spring 116. The torsion spring 116 surrounds the support shaft 96 and the shaft sleeve 107 and includes a first end 118 positioned in contact with the flange 108. The second end 120 of the torsion spring is securely fixed to the outer race of a slip clutch 122. The inner race of the slip clutch 122 is coupled to an adjustment spring 124. The adjustment spring 124 controls the amount of rotational force required by the torsion spring 116 before the slip clutch 122 releases. The adjustment spring 124 has its outer end in contact with a washer 126 whose position is controlled by a pair of adjustable nuts 128 and 129. Thus, rotational adjustment of the nut 128 controls the force of adjustment spring 124 and thus the maximum amount of loading on the torsion spring 116.

As can be understood in FIG. 7, when the supply roll 20 is unwound, the rotation of the shaft sleeve 107 winds the torsion spring 116. As the torsion spring 116 is wound, the torsion spring 116 exerts a rotational force on the slip clutch 122 through the second end 120 of the torsion spring 116. The release between the inner race and outer race of the slip clutch 122 is controlled by the adjustment spring 124. Once the bias force created by the torsion spring 116 exceeds the force of the slip clutch 122, the inner race and the outer race of the slip clutch 122 disengage to release the tensioning load on the bias member 114. In this manner, the slip clutch 122 limits the amount of loading on the torsion spring 116.

Once the continuous strip of bags is no longer being pulled from the supply roll 26 by the bag feeding assembly, the torsion spring 116 rotates the flange 108 and shaft sleeve 107 to rewind the continuous strip of bags onto the supply roll 26. In this manner, the combination of the torsion spring 116 and slip clutch 120 maintain proper bag tension on the continuous strip of bags.

Figure 7A:
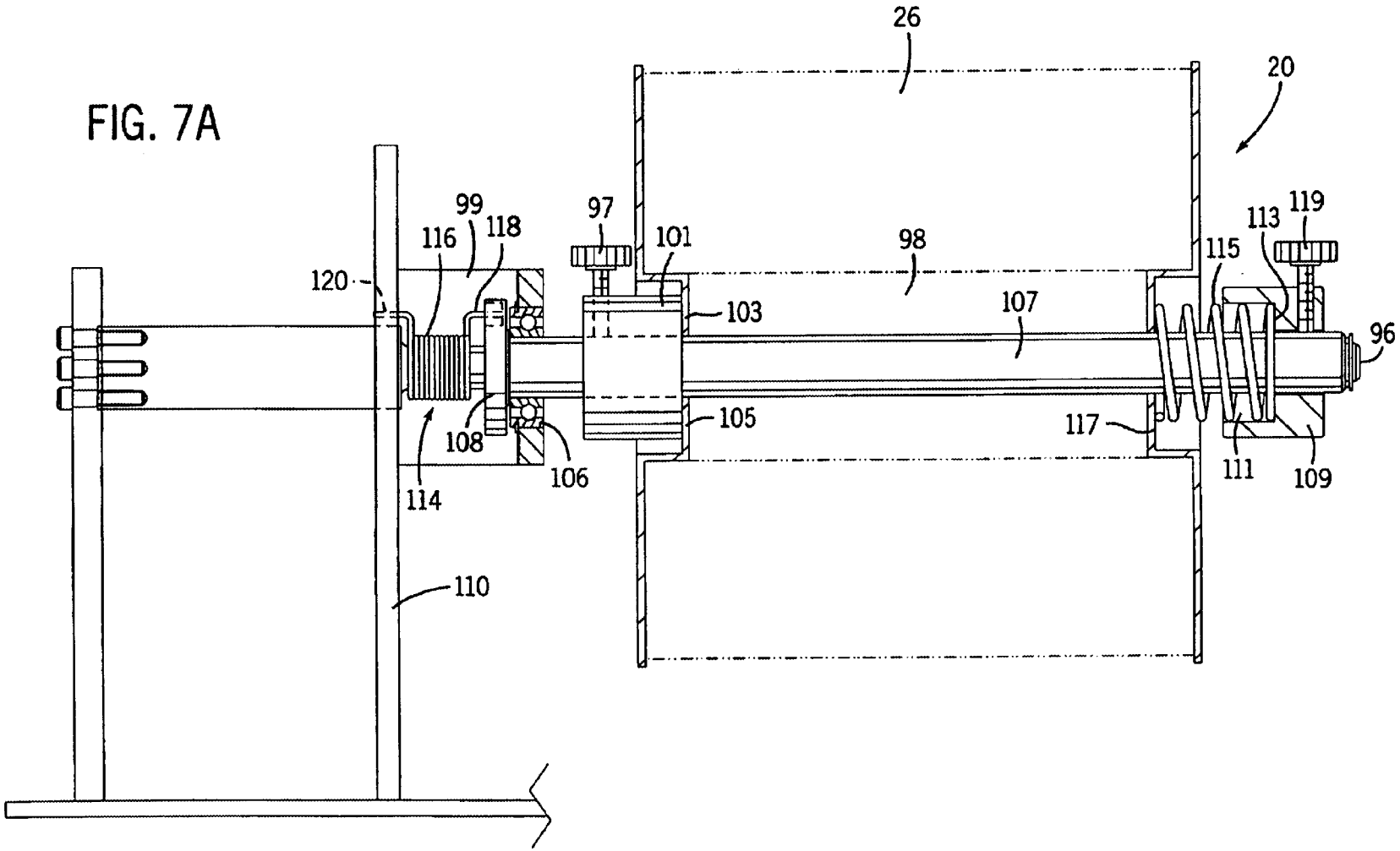
FIG. 7*a* is a view similar to FIG. 7 illustrating a second embodiment of the bag tensioning assembly of the present invention.

Referring now to FIG. 7*a*, thereshown is a second embodiment of the bag tensioning assembly 20 of the present invention. The support shaft 96 passes through the core 98 of the supply roll 26, and extends into a mounting block 99 that is supported by the wall 110. The mounting block 99 includes the bearing assembly 106 that allows the shaft sleeve 107 to freely rotate.

In the second embodiment of the invention, the bias member 114 is positioned around the shaft sleeve 107. In the second embodiment, the bias member 114 is a torsion spring 116. The torsion spring 116 surrounds the support shaft 96 and the shaft sleeve 107 and includes the first end 118 positioned in contact with flange 108 formed on the shaft sleeve 107. The second end 120 of the torsion spring 116 is fixed to the support wall 110 such that as the shaft sleeve 107 rotates, the torsion spring 116 continues to load. Unlike the first embodiment illustrated in FIG. 7, a slip clutch is not utilized in the second embodiment of the invention.

As can be seen in FIG. 7*a*, a friction block 101 is mounted around the shaft sleeve 107. The friction block 101 has an inner surface 103 that contacts a face surface 105 of the core 98. A locking knob 97 is used to secure the friction block 101 along the shaft sleeve 107. The frictional interaction between the inner surface 103 of the friction block 101 and the face surface 105 of the core 98 secures the core 98 to the shaft sleeve 107.

As can be seen in FIG. 7*a*, friction collar 109 is mounted to the outer end of the support shaft 96. The friction collar 109 includes a spring cavity 111 that terminates with a back surface 113. The spring cavity 111 receives an outer end of a tension spring 115. The opposite end of the tension spring 115 contacts the inner face 117 of the core 98. The friction collar 109 is secured to the support shaft 96 by a locking knob 119. The locking knob 119 can be tightened to secure the friction collar 109 to the shaft sleeve 107.

As can be understood in FIG. 7*a*, the axial movement of the friction collar 109 along the support shaft 96 compresses the tension spring 115. As the tension spring 115 is compressed, a greater amount of pressure exists between the friction block 101 and the core 98. The amount of pressure between the core 98 and the friction block 101 determines the amount of loading on the torsion spring 116 before the core 98 slips relative to the friction block 101.

As can be understood in FIG. 7*a*, when the supply roll 20 is unwound, the rotation of the shaft sleeve 107 winds the torsion spring 116. As the torsion spring is wound, the torsion spring 116 exerts a rotational force on the shaft sleeve 107 and thus between the friction block 101 and the surface 105 of the core 98. The friction force between the inner surface 103 of the friction block 101 and the surface 105 of core 98 is controlled by the tension spring 115. Once the rotational bias force created by the torsion spring 116 exceeds the friction force between the friction block 101 and the core 98, the core 98 slips and rotates about the support shaft 96 without further loading the torsion spring 116. In the second embodiment of the invention illustrated in FIG. 7, the brief slippage between the friction block 101 and the core 98 does not allow the torsion spring 116 to unwind quickly, as may be the case in the first embodiment shown in FIG. 7.

In the second embodiment of the invention, the tension spring 115 limits the amount of loading on the torsion spring 116. The force created by the tension spring 115 can be controlled by the axial distance the friction collar 109 is moved along the support shaft 96.

As with the first embodiment, once the continuous strip of bags is no longer being pulled from the supply roll 26, the torsion spring 116 rotates the flange 108 and shaft sleeve 107 to rewind the continuous strip of bags onto the supply roll 26. In this manner, the combination of the torsion spring 116 and the friction collar 109 maintain proper tension on the continuous strip of bags.

Referring now to FIGS. 2 and 3, the printer assembly 22 is pivotable between the loading position of FIG. 3 and the printing position of FIG. 2. The printing assembly 22 includes an external housing 130 defined by a pair of sidewalls 132. Each of the sidewalls 132 includes a depending ear 134 that is pivotally connected to the support frame 14 by a pivot point 136. The pivot points 136 allow the pivoting movement of the entire printer assembly 22, as illustrated.

As shown in FIG. 3, a support strut 138 is positioned between the support frame 14 and the sidewall 132 to support the printer assembly 22 in the loading position. As illustrated in FIGS. 2 and 3, rod 139 is movable into body 142 such that the strut 138 is movable between the extended position of FIG. 3 and the compressed position of FIG. 2.

When the printer assembly 22 is in the loading position of FIG. 3, the continuous strip of bags 24 can be easily fed over the support roller 28 and the drive roller 30 and platen roller 32. The continuous strip of bags 24 rests upon the outlet plate 44.

After the continuous strip of bags 24 has been loaded over the bag feeding assembly 16, the printer assembly 22 is pivoted downward into the position shown in FIG. 2. When the printer assembly 22 is in the printing position, as illustrated in FIG. 10, a tension roller 140 is biased into contact with the drive roller 30. Specifically, a tension spring 142 exerts a downward bias force to create a nip between the tension roller 140 and the drive roller 30. The tension between the tension roller 140 and the drive roller 30 allows the drive roller 30 to pull the continuous strip of bags 24 through the packaging apparatus of the present invention. Additionally, the tension roller 140 prevents the bag torsioning assembly from completely rewinding the strip of bags onto the supply roll when the bag feeding assembly is not actively unwinding the strip of bags.

Referring now to FIG. 3, the printer assembly 22 includes a print head 144 that is movable along with the printer assembly 22. The print head 144 is controlled by the control unit of the packaging apparatus and is operable to print desired information onto each bag of the continuous strip. A printer ribbon 146 passes beneath the print head 144 such that the printer ribbon 146 is positioned between the print head 144 and the continuous strip of bags 24, as illustrated in FIG. 9. When the print head 144 is in the printing position illustrated in FIG. 9, the platen roller 32 is in contact with the print head 144 and rotation of the platen roller 32 draws the printer ribbon 146 past the printer head 144.

As illustrated in FIG. 3, the tension roller 140 is mounted within the printer assembly 22 such that when the printer assembly 22 is pivoted to the printing position of FIG. 3, the tension roller 140 is moved away from contact with the drive roller 30. Thus, when printer assembly 22 is in the loading position, the continuous strip of bags can be easily loaded. Once the strip of bags is loaded, the printer assembly 22 is moved back to the printing position of FIG. 2 such that the tension roller 140 creates an infeed nip with the drive roller 30.

Figure 8:
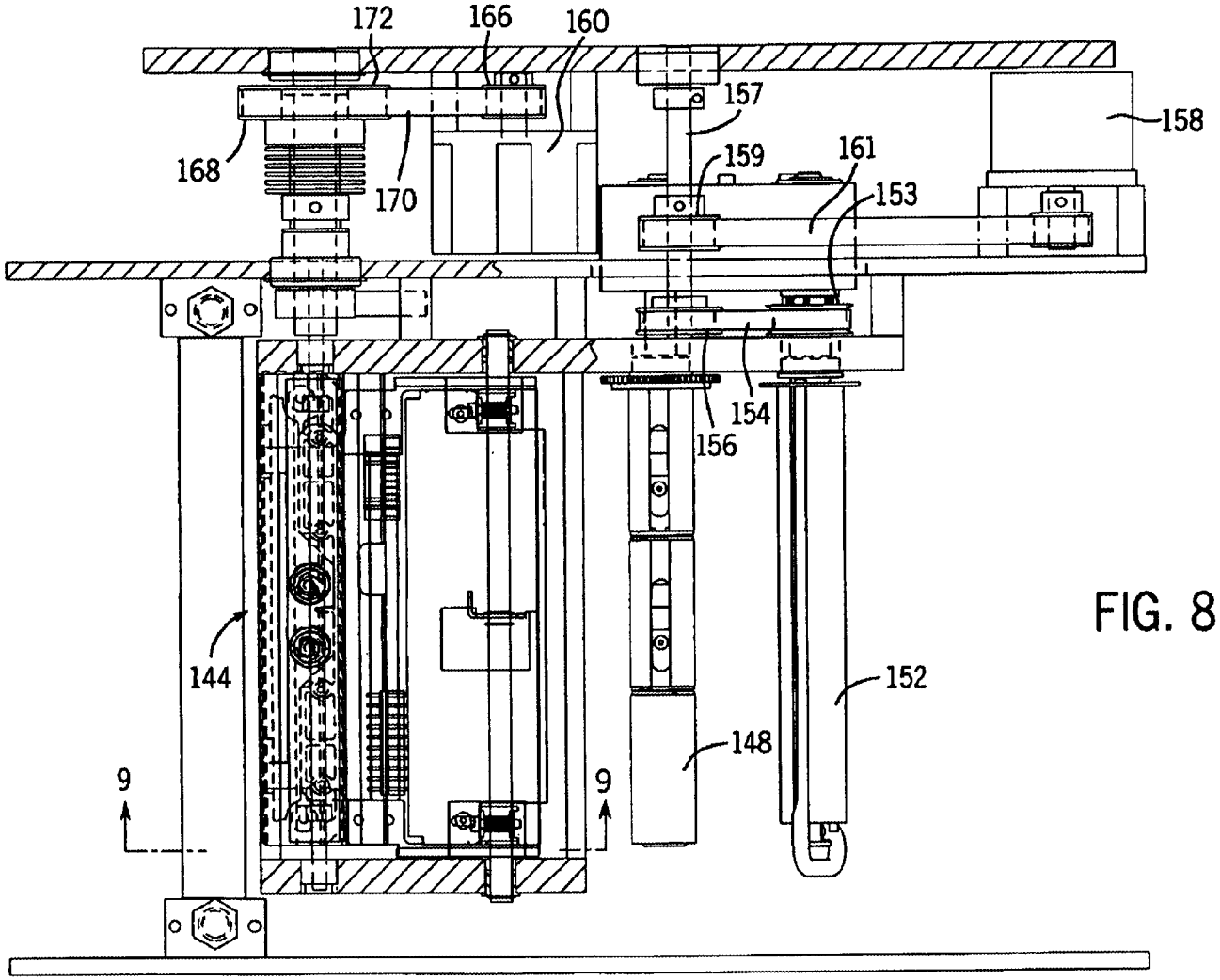
FIG. 8 is a top view taken along line 8—8 of FIG. 2.

Referring back to FIG. 3, the printer ribbon is contained on a supply roll 148 and is pulled past the printer head 144 by the platen roller 32. After the printer ribbon 146 has been used, as illustrated in FIG. 9, the printer ribbon 146 passes around a guide roller 150 and is accumulated onto a take-up roller 152, as illustrated in FIG. 3. The take-up roller 152 includes pulley 153 that is coupled by a drive belt 154 to a take-up pulley 156, as shown in FIG. 8. The take-up pulley 156, in turn, is connected to a shaft 157 having a pulley 159 coupled to a printer ribbon take-up drive motor 158 by belt 161. Thus, when the printer assembly 22 is printing indicia on bags, the take-up motor 158 operates to drive the take-up roller 152 to accumulate the supply of used printer ribbon.

Referring back to FIG. 8, a printer drive motor 160 is shown having a pulley 166. The pulley 166 is coupled to a slip clutch 168 by a drive belt 170. The slip clutch 168 controls the movement of the print head 144, as will be described.

Referring now to FIGS. 9 and 10, thereshown is the movement of the print head 144 between the printing position (FIG. 9) and the retracted position (FIG. 10). The controller for the packaging apparatus 10 of the present invention controls the movement of the print head 144 between the positions illustrated in FIGS. 9 and 10. As described previously, the print head 144 is moved to the printing position only when the print head 144 is printing indicia onto the continuous strip of bags. At other times during the operating sequence of the packaging apparatus, the print head 144 is moved out of contact with the platen roller 32 such that the platen roller 32 does not draw any further printer ribbon 146 from the ribbon supply roll 148.

The movement of the print head 144 from the retracted position of FIG. 10 to the printing position of FIG. 9 is controlled by operation of the printer drive motor 160. In the preferred embodiment of the invention, the printer drive motor 160 is a conventional stepper motor operable in a forward and reverse direction. When the printer drive motor 160 is operated, the printer drive belt 170 rotates the slip clutch pulley 172, as illustrated in FIG. 8. As the slip clutch pulley 172 rotates, shaft 174 and the attached cam member 176 rotate in the counter-clockwise direction, as illustrated in FIG. 10. As the cam member 176 rotates, the cam member contacts bracket 178 and moves the print head 144 downward into contact with the platen roller 32, as illustrated in FIG. 9. The stepper drive motor 160 is operated such that the motor 160 stops operation when the print head 144 is in contact with the platen roller 32. The torque of the printer drive motor 160 holds the print head 144 in the printing position.

Once the print head 144 is in the position shown in FIG. 9, the platen roller 32 pulls the supply of printer ribbon 146 past the printer head 144 where printed indicia can be applied to each of the individual bags.

Once printing has been completed, the printer drive motor 160 reverses direction causing the printer head 144 to return to the retracted position illustrated in FIG. 10. In the retracted position, the print head 144 is no longer in contact with the platen roller 32. At this time, the drive roller 30 can pull the continuous strip of bags 24 without indexing any further printer ribbon 146.

As can be understood in FIGS. 3 and 9, the driven platen roller 32 remains mounted to the support frame 14, while the print head 144, and the entire printer assembly 22, pivot away from the bag filling assembly 16. In this manner, the drive motor 40 feeds the printer ribbon and the continuous strip of bags and is included on the stationary support frame 14, while the print head 144 and printer ribbon take-up mechanism is included within the pivotable printer assembly 22.

Referring back to FIGS. 2 and 3, the printer assembly 22 includes a locking bracket 180. The locking bracket 180 engages a fixed portion of the support frame to hold the printer assembly 22 in the closed, printing position.

Various alternatives and embodiments are contemplated as being within the scope of the following claims particularly pointing out and distinctly claiming the subject matter regarded as the invention.

We claim:

1. A packaging apparatus for printing information on each bag of a continuous strip of bags and positioning the bag for loading with a product, the apparatus comprising:

a support frame;

a bag feeding assembly mounted to the support frame, the bag feeding assembly including a drive roller operable to receive the continuous strip of bags and advance the continuous strip of bags through the packaging apparatus; and a printer assembly pivotally mounted to the support frame and movable between a loading position and a printing position, the printer assembly including a supply of printer ribbon and a print head movable independently of the movement of the printer assembly between a printing position and a retracted position, the print head being operable to print selected information onto each individual bag as the bag moves through the printer assembly, the printer assembly further including a tension roller positioned to create an infeed nip with the drive roller when the printer assembly is in the printing position;

wherein the printer assembly is pivotally movable between the loading position in which the print head and tension roller are spaced from the support frame and drive roller of the bag feeding assembly to allow the continuous strip of bags to be fed over the drive roller and a printing position in which the tension roller engages the drive roller to create the infeed nip and the print head is adjacent the bag feeding assembly.

2. The packaging apparatus of claim 1 wherein the bag feeding assembly includes a platen roller operable to feed the supply of printer ribbon through the printer assembly.

3. The packaging apparatus of claim 2 wherein the drive roller and the platen roller are coupled to a common drive motor.

4. The packaging apparatus of claim 3 wherein the print head is positioned to contact the platen roller when the printer assembly is in the printing position and the print head is in the printing position, wherein the platen roller is operable to advance the printer ribbon only when the print head is in contact with the platen roller.

5. The packaging apparatus of claim 3 wherein the printer assembly includes a printer ribbon take-up spool coupled to a printer ribbon take-up motor, wherein the printer ribbon take-up motor is operable to rotate the take-up spool to receive the printer ribbon fed through the printer assembly by the platen roller when the print head is in contact with the platen roller.

6. The packaging apparatus of claim 3 wherein the print head is coupled to a cam assembly, the cam assembly being coupled to a printer drive motor such that the printer drive motor is operable to move the print head into the printing position and into contact with the platen roller.

7. The packaging apparatus of claim 1 further comprising a bag sealing assembly operable to seal each bag after the bag has been printed and loaded with product, the bag sealing assembly being mounted to the support frame and movable between an extended position and a retracted, sealing position.

8. The packaging apparatus of claim 7 wherein the bag sealing assembly includes a pressure bar mounted between a pair of spaced side arms, wherein the side arms are movable relative to the support frame to move the pressure bar between the extended position and the sealing position.

9. The packaging apparatus of claim 8 wherein each of the side arms includes a rack member that receives a drive gear, wherein the drive gears are rotatably driven by a sealing drive motor to move the pressure bar between the extended position and the sealing position.

10. The packaging apparatus of claim 9 wherein the sealing motor is an electric motor.

11. The packaging apparatus of claim 1 further comprising a bag tensioning assembly operable to support the continuous strip of bags wound onto a supply roll, the bag tensioning assembly being operable to maintain tension on the continuous strip of bags as the bags are unwound through the packaging apparatus.

12. The packaging apparatus of claim 11 wherein the bag tensioning assembly further comprises:

a rotatable support shaft positioned to support the supply roll;

a bias member coupled to the support shaft and operable to maintain tension on the continuous strip of bags, wherein rotation of the support shaft as the continuous strip of bags is withdrawn from the supply roll loads the bias member, wherein the bias member exerts a bias force on the support shaft to wind the continuous strip of bags onto the supply roll.

13. The packaging apparatus of claim 12 wherein the bias member is a torsion spring.

14. The packaging apparatus of claim 13 further comprising a slip clutch positioned between the torsion spring and the support shaft, wherein the slip clutch limits the loading of the torsion spring.

15. A packaging apparatus for printing information on each bag of a continuous strip of bags wound on a supply roll and positioning each bag for loading with a product, the apparatus comprising:

a support frame;

a bag feeding assembly mounted to the support frame, the bag feeding assembly being operable to receive the continuous strip of bags and unwind the continuous strip of bags from the supply roll;

a printer assembly mounted to the support frame, the printer assembly including a supply of printer ribbon and a print head operable to print selected information on each individual bag as the bag moves through the printer assembly;

a bag tensioning assembly operable to support the supply roll of bags, the bag tensioning assembly being operable to maintain tension on the continuous strip of bags as the bags are unwound from the supply roll by the bag feeding assembly, the bag tensioning assembly including a rotatable support shaft positioned to support the supply roll and a torsion spring coupled to the support shaft, wherein operation of the bag feeding assembly to unwind the supply roll loads the torsion spring such that the torsion spring exerts a rotational bias force on the support shaft to wind the continuous strip of bags onto the supply roll; and a slip clutch positioned between the torsion spring and the support shaft, wherein the slip clutch limits the loading of the torsion spring as the bag feeding assembly unwinds the continuous strip of bags from the supply roll;

wherein the slip clutch includes an outer bearing race coupled to the torsion spring and an inner bearing race coupled to a setting spring, wherein the setting spring is operable to select the load applied to the torsion spring.

16. A packaging apparatus for printing information on each bag of a continuous strip of bags wound on a supply roll and positioning each bag for loading with a product, the apparatus comprising:

a support frame;

a bag feeding assembly mounted to the support frame, the bag feeding assembly being operable to receive the continuous strip of bags and unwind the continuous strip of bags from the supply roll;

a printer assembly mounted to the support frame, the printer assembly including a supply of printer ribbon and a print head operable to print selected information on each individual bag as the bag moves through the printer assembly;

a bag tensioning assembly operable to support the supply roll of bags, the bag tensioning assembly being operable to maintain tension on the continuous strip of bags as the bags are unwound from the supply roll by the bag feeding assembly, the bag tensioning assembly including a rotatable support shaft positioned to support the supply roll and a torsion spring coupled to the support shaft, wherein operation of the bag feeding assembly to unwind the supply roll loads the torsion spring such that the torsion spring exerts a rotational bias force on the support shaft to wind the continuous strip of bags onto the supply roll; and a tension spring positioned to create a friction force to couple the supply roll of bags to the support shaft, wherein the tension spring limits the loading of the torsion spring as the bag feeding assembly unwinds from the continuous strip of bags form the supply roll.

17. The packaging apparatus of claim 16 wherein the tension spring forces the supply roll into contact with a friction block mounted to the support shaft, wherein the supply roll rotates relative to the friction block when the bias force exceeds the friction force.

18. A packaging apparatus for printing information on each bag of a continuous strip of bags wound onto a supply roll and positioning each bag for loading with a product, the apparatus comprising:

a support frame;

a bag feeding assembly mounted to the support frame, the bag feeding assembly being operable to unwind the continuous strip of bags from the supply roll and advance the continuous strip of bags through the packaging apparatus, the bag feeding assembly including a drive roller and a platen roller coupled to a common drive motor;

a printer assembly pivotally mounted to the support frame, the printer assembly including a supply of printer ribbon and a print head movable between a printing position and a retracted position, the print head being operable to print selected information on each individual bag as the bag moves through the printer assembly, wherein the printer assembly is pivotally movable independently of the movement of the print head between a loading position in which the printer assembly is spaced from the support frame and the drive roller of the bag feeding assembly to permit the continuous strip of bags to be fed over the drive roller and a printing position in which the printer assembly is adjacent to the bag feeding assembly and a tension roller of the printer assembly is in contact with the drive roller to create an infeed nip;

a bag tensioning assembly operable to support the supply roll, the bag tensioning assembly being operable to maintain tension on the continuous strip of bags as the bags are unwound by the bag feeding assembly; and a bag sealing assembly mounted to the support frame and movable between an extended position and a retracted, sealing position, wherein when the bag sealing assembly is in the sealing position, the sealing assembly is operable to seal each bag after the bag has been printed and loaded with a product.

19. The packaging apparatus of claim 18 wherein the print head is positioned to contact the platen roller when the printer assembly is in the printing position and the print head is in the printing position, the platen roller being operable to advance the printer ribbon only when the print head is in contact with the platen roller.

20. The packaging apparatus of claim 18 wherein the printer assembly includes a printer ribbon take-up spool coupled to a ribbon take-up motor, wherein the ribbon take-up motor is operable to rotate the take-up spool to receive the printer ribbon fed through the printer assembly by the platen roller when the print head is in contact with the platen roller.

21. The packaging apparatus of claim 20 wherein the print head is coupled to a cam assembly, the cam assembly being coupled to a printer drive motor such that the printer drive motor is operable to move the print head into contact with the platen roller.

22. The packaging apparatus of claim 18 wherein the bag sealing assembly includes a pressure bar mounted between a pair of spaced side arms, wherein the spaced side arms are movable relative to the support frame to move the pressure bar between the extended position and the sealing position.

23. The packaging apparatus of claim 22 wherein each of the side arms includes a rack member that receives a drive gear, wherein the drive gears are rotatably driven by a sealing motor to move the pressure bar between the extended position and the sealing position.

24. The packaging apparatus of claim 23 wherein the sealing motor is an electric motor.

25. The packaging apparatus of claim 18 wherein the bag tensioning assembly further comprises:

a rotatable support shaft positioned to support the supply roll; and a bias member coupled to the support shaft and operable to maintain tension on the continuous strip of bags, wherein rotation of the support shaft as the continuous strip of bags is withdrawn from the supply roll loads the bias member, wherein the bias member exerts a bias force on the support shaft to wind the continuous strip of bags onto the supply roll.

26. The packaging apparatus of claim 25 wherein the bias member is a torsion spring.

27. The packaging apparatus of claim 26 further comprising a slip member positioned to limit the loading of the torsion spring as the bag feeding assembly unwinds the continuous strip of bags from the supply roll.

28. The packaging apparatus of claim 27 wherein the slip member is adjustable to select the load applied to the torsion spring.

* * * * *